United States Patent [19]

Hartman et al.

[11] 3,961,697

[45] June 8, 1976

[54] APPARATUS FOR SHINGLING AND PACKING OF ARTICLES

[75] Inventors: Donn A. Hartman, Zion; Charles E. Cloud, Wilmette, both of Ill.

[73] Assignee: R. A. Jones & Company Inc., Covington, Ky.

[22] Filed: Mar. 20, 1974

[21] Appl. No.: 452,798

[52] U.S. Cl. ..... 198/25; 198/31 AA; 198/103; 198/179; 214/1 BV; 214/6 FS

[51] Int. Cl.[2] ..... B65G 47/00

[58] Field of Search ..... 198/235, 287, 286, 285, 198/76, 103, 25, 30, 20, 31 R, 179.31 AA, 167, 209, DIG. 1, 35, 62; 53/159, 161; 271/194, 196, 83; 214/1 BS, 6 FS, 1 BV, 6 DS

[56] References Cited

UNITED STATES PATENTS

| | | | |
|---|---|---|---|
| 1,263,515 | 4/1918 | Biehler et al. | 53/159 UX |
| 3,160,260 | 12/1964 | Holland, Jr. | 198/35 |
| 3,435,584 | 4/1969 | Prechter | 53/159 |
| 3,603,449 | 9/1971 | Snow | 198/167 |
| 3,661,242 | 5/1972 | Clancy | 53/159 |
| 3,677,391 | 7/1972 | Schaeffer | 198/76 |
| 3,822,008 | 7/1974 | Benner et al. | 198/25 |

*Primary Examiner*—Robert J. Spar
*Assistant Examiner*—James M. Slattery
*Attorney, Agent, or Firm*—Wood, Herron & Evans

[57] ABSTRACT

An apparatus for packaging articles received as a strip having individually filled pouches which are separated by transverse seals at opposite ends of the pouches characterized by severing the pouches and then depositing the pouches on a conveying device which transports the pouches to the receptacle in which they are stacked. Preferably, the apparatus utilizes a cutting device which comprises an index wheel and a cutting wheel with the index wheel being provided with suction heads to grip the severed pouches to transport them to a position above the conveying device where they are positively ejected onto the conveying device in two rows which are preferably overlapping to reduce the width of the two rows on the conveying device. In depositing the pouches on the conveying device, they are placed in a shingled relationship with the leading edge of each pouch overlapping and overlying the trailing edge of the preceding pouch and the conveying device includes a device for reversing the direction of the shingled pouches so that as the pouches are received by a chute for stacking in a receptacle, the trailing edge of each pouch is overlapping and overlying the leading edge of the following pouch.

18 Claims, 7 Drawing Figures

APPARATUS FOR SHINGLING AND PACKING OF ARTICLES

BACKGROUND OF THE INVENTION

FIELD OF THE INVENTION

The present invention is directed to a apparatus for handling articles and preferably for packaging a plurality of articles which are presented in a strip of articles which are subsequently severed, deposited on a transporting or conveying device and then subsequently inserted in a receptacle such as a box.

In recent years it has been popular in restaurants to provide sugar, salt and condiments such as mustard and ketchup in individual packages for use by the customer. To package either a granular matter such as sugar and salt or a paste or liquid such as mustard or ketchup, it has been proposed to utilize a machine which folds a strip of paper or packaging material into a trough, forms individual pouches in the fold strip which are subsequently passed through a filling device to receive the contents through an open edge or side which is subsequently sealed. After sealing the filled pouch, it is severed from the strip and deposited in a receptacle such as a carton for shipment. Examples of this type of packaging machine and process are disclosed in U.S. Pat. No. 3,344,576, which issued to Charles E. Cloud et al. on Oct. 3, 1967 and U.S. Pat. No. 3,667,188, which issued to Benner, Jr. et al. on June 6, 1972.

To improve the handling of the individual severed pouches or packages, it has been proposed to use a cutting wheel working in conjunction with an index wheel which moves the strip of pouches in an arcuate path and severs the pouches in a step-like manner therefrom. To control the movement of the severed pouch or packet, various arrangements including the provision of a vacuum head have been suggested. Examples of these devices are disclosed in U.S. Pat. No. 3,597,898, which issued to Charles E. Cloud on Aug. 10, 1971.

It has been one practice to sell such pouches in bulk by packing them somewhat at random in a cartons, 2,000 pouches being packed in a carton. This type of cartoning obviously is very simply done. There has, however, been a demand for cartons containing smaller numbers of pouches as, for example, 100 to 200 pouches per carton. These smaller units are particularly useful to a restaurant, for example, for inventory control and for the convenience and efficiency of the waitress as she replenishes the pouches normally placed in a container at each table.

There are several approaches to the packing of small numbers of pouches in cartons. The simplest form is to hand pack the cartons wherein an operator might place the pouches, in groups of five, into a carton until the full complement of 100 or 200 is packed. On the other extreme is an automatic machine of the type disclosed in Cloud et al. application Ser. No. 389,804, filed Aug. 20, 1973, wherein the pouches are automatically counted and packed into a carton.

The present invention represents a compromise between the two extremes described above. In accordance with the present invention, pouches are automatically oriented in shingle fashion on a chute for packing into a carton, the oriented pouches simply being hand slid by an operator along the chute into a carton mounted on the chute. The use of the present invention permits the cartoning to be performed by a single operator approximately ten times as fast as the hand packing operation described above and yet costs only one-fifth the cost of an automatic machine.

SUMMARY OF THE INVENTION

The present invention is directed to a apparatus for handling articles, such as pouches which have been individually filled with material. The apparatus achieves an improved packing factor of the articles in a receptacle with a minimum expense for labor. To accomplish these objects, the invention includes a apparatus for reversing the shingled direction of a stream of shingled articles to improve their insertion into the receptacle. To improve the packing factor of the articles in a receptacle, the invention provides means for depositing the articles in two rows with the marginal edges of the articles overlapping and the articles in each row being in a shingled relationship which shingled relationship is subsequently reversed to facilitate packing in a receptacle such as a box. Preferably, the articles are pouches which are received as a strip of individually filled pouches and are moved in an arcuate path on an index wheel and severed into individual packets by a cutting wheel with one of the wheels being provided with suction heads for grasping the article and transporting it for discharge on a material receiving device such as a conveyor means by positively ejecting the packet from the suction head by the application of a positive pressure. The conveyor passes below and at right angles to the path of the index wheel. To obtain two rows on the conveying device or means, the positive pressure that is pressure above atmospheric, is applied to the suction heads at different points of travel for alternate suction heads, thereby dropping two pouches substantially side-by-side.

The preferred embodiment utilizes an index wheel having cutting bars and a cutting wheel having cutting bars with the suction heads disposed on the index wheel between the cutting bars. The index wheel is provided with means for applying a vacuum to the suction heads and means to apply a positive pressure as the suction head reaches a discrete position or point of its travel to deposit a package grasped by the suction head onto the conveyor means in a shingled orientation with the marginal edges of one row overlying and overlapping the marginal edges of the other row. The conveyor means preferably includes means for reversing the direction of the shingled articles of both rows without destroying the overlapping relationship of the adjacent rows. The conveyor means transports the shingled rows having the reversed orientation to a chute which facilitates packing the shingled rows as stacks in a receptacle.

DESCRIPTION OF THE PREFERRED EMBODIMENT

Figure 1:
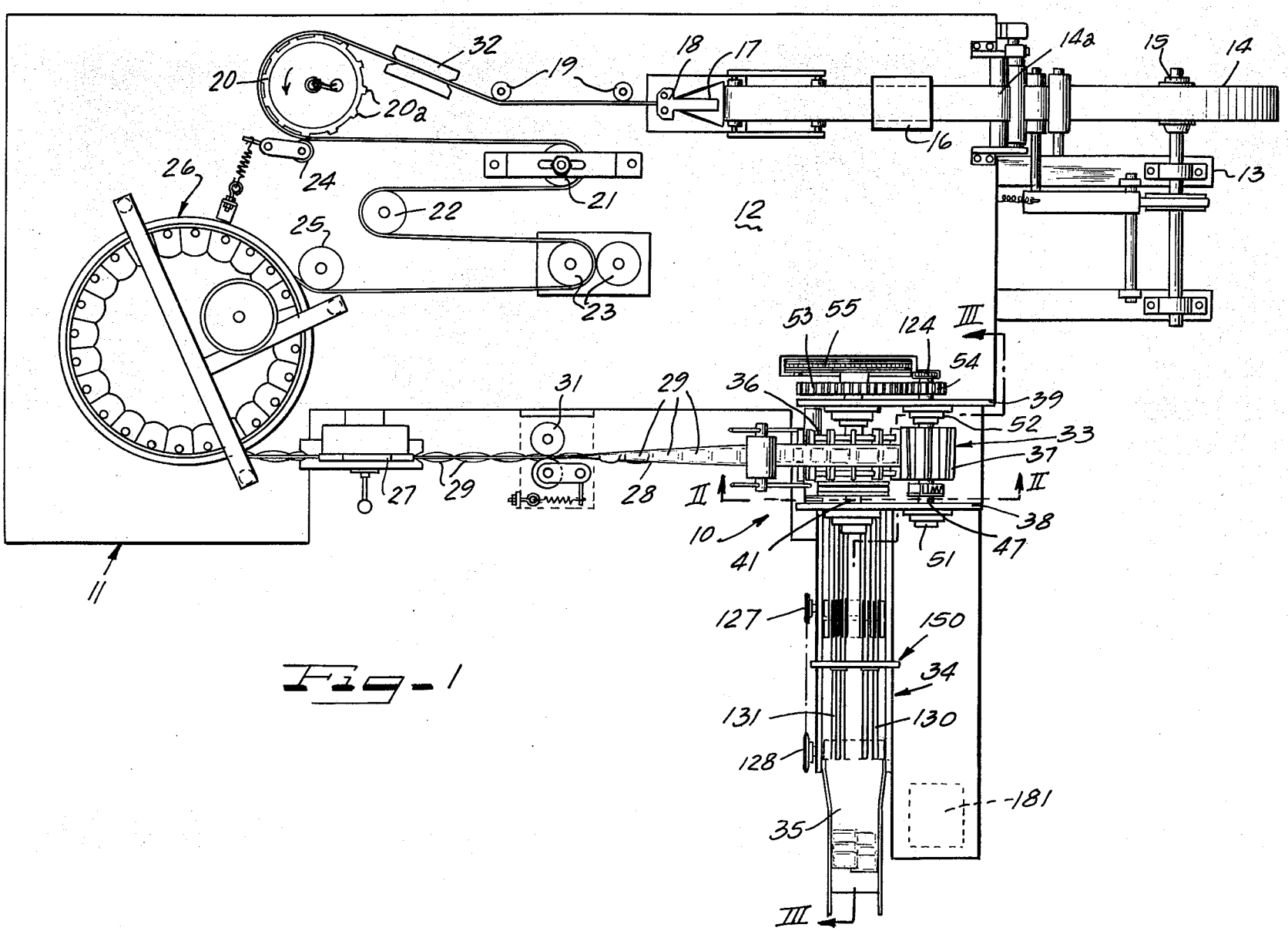
FIG. 1 is a top plan view of the apparatus of the present invention.

The principles of the present invention are particularly useful in an apparatus generally indicated at 10 in FIG. 1 for severing articles from the strip and depositing the severed articles into stacks in a receptacle or box. Although the apparatus and method of the present invention can be utilized to operate on a strip of articles, it is illustrated as being a final station in a packaging machine generally indicated at 11 in FIG. 1.

The machine 11 has a horizontal base 12 supporting various components. Mounted adjacent to the base 12 is means comprising a roll stand 13 for supporting a roll 14 of packaging material. The roll 14 is supported on an arbor 15 in such a way that when a strip 14*a* is unrolled therefrom, it is disposed in a generally vertical plane and is turned to a general horizontal plane over the base 12. The strip 14*a* may be of any suitable type and may be paper which is coated on at least one side with a sealable material such as a plastic or other suitable adhesive.

It is contemplated that the strip may be either preprinted or as illustrated in FIG. 1 a printing device 16 may be employed downstream from the roll 14.

Downstream from the printing device 16, the strip 14*a*, is engaged by a suitable paper plow 17, which is supported on a paper plow bracket 18 on the base 12. The plow 17 folds the strip 14*a* with the fold being disposed at the bottom of the strip and the strip will have generally V-shaped transverse cross section.

In order to further prepare the strip 14a so that filled packages may be formed, the strip is fed over guide rolls 19, 19 to a vertical sealer 20 which moves the strip 14a in an arcuate path as a drum of the sealer 20 rotates in a direction indicated by the arrow. From the sealer 20, the strip is passed over an adjustable idler roll 21, a fixed idler roll 22 and through a pair of drive rolls 23. As illustrated, the sealer 20 has vertical lands such as 20*a* which are heated by an appropriate means and which form vertical or tranverse extending seals across the strip 14*a* at a given spacing which is determined by the spacing between the lands. To insure the formation of the seals, a pressure roll 24 coacts with the lands to insure sufficient pressure to create the seals. As the strip moves toward the roll 21, the strip has a series of pockets or pouches with an opened edge or side which pockets are defined by the transverse seals and bottom fold.

From the drive roll 23, the strip with the pouches is passed over an idler roll 25 and then to a filling station 26 which is provided with appropriate means for opening the pockets and inserting a given quantity of material such as sugar into each pouch. From the filling station 26, the strip with the material in the pouches or pockets passes through a top sealer 27, which seals the remaining opened side to close the filled pouches to form a strip 28 of packages or pouches 29 separated by transverse seals 30. From the sealer 27, the strip 28 passes through a drive means 31 and then to the apparatus 10 of the present invention. For a detailed description of the operation and structure of the filling station 26, reference is made to the above-mentioned Cloud et al. U.S. Pat. No. 3,344,576. While the filling station was illustrated as one for filling the pouches with a dry material, such as salt or sugar, an appropriate filling device for a liquid such as ketchup or mustard could be substituted for the device illustrated at 26. An example of such a device is disclosed in greater detail in Benner, Jr. et al., U.S. Pat. No. 3,667,188.

The filled pouches leaving the drive means 31, which may consist of a capstan and pressure roll, are provided with transverse seals 30, a top seal with the bottom being closed by the fold being produced by the plow 17. If it is desirable to have a seal on all four sides of the packets, a bottom sealer 32 having a conventional heated head can be utilized to form a seal along the fold or crease. The bottom sealer 32 can be placed in the path of the strip or web before the vertical sealer 20, as illustrated, or subsequent to the vertical sealer. While the above description was directed to a device in which a single sheet was folded to provide the pouches, pouches formed by sealing two sheets together can also be utilized.

The strip 28 as viewed in FIG. 1 is moved in a vertical plane which is substantially perpendicular to the plane of FIG. 1, and, after passing through the drive means 31, the strip 28 is twisted to a horizontal condition to be received by the apparatus 10.

The apparatus 10, includes means, generally indicated at 33, for sequentially severing the packages or pouches 29 from the strip 28 for depositing the severed pouches 29 on a conveyor means generally indicated at 34. The conveyor means 34 transports the severed packages to a chute 35.

The means 33 for severing includes an index wheel 36 and a cutting wheel 37 which are both rotatably supported in a frame composed of upright frame members 38 and 39. The index wheel 36 (FIG. 2) includes a core 40 which has a bore for receiving a drive shaft 41. A key 42 directly connects the core 40 to rotate with the shaft 41. The drive shaft 41 (FIG. 3) is rotatably supported in conventional bearings 43 and 44 which in turn are supported on frame members 38 and 39, respectively.

The cutting wheel 37 (FIG. 2) includes a core 45 which supports a plurality of cutting bars or blades 46 which are circumferentially spaced on the wheel 37. The core 45 has an axial bore which loosely receives a drive shaft 47 and has an axially extending tab 48. The shaft 47 rigidly supports a spring clutch device 49 which has a spring 50 to yieldably connect the shaft 47 to the wheel 37 via the axial tab or member 48. The shaft 47 is supported for rotation on the upright members 38 and 39 by a pair of bearings 51 and 52 (FIG. 1), respectively.

To rotate the index wheel 36 and the cutting wheel 37 in the desired speed relationship, the shaft 41 has a drive gear 53 which engages a drive gear 54 which is keyed to the shaft 47. The shaft 41 is driven through a drive means including a chain drive 55 which is connected to the main drive system (not illustrated) for the machine 11. By the interconnecting of the chain drive 55 with the drive system of the machine 11, the rotation of the index wheel and cutting wheel will be synchronized with the rotation of the various elements of the machine 11 and the speed of advance of the tape through the machine 11 and apparatus 10 will be the same.

The index wheel 36 (FIG. 2) has a plurality of cutting blades or bars 60 which are circumferentially spaced around the core 40. Attached to each of the cutting blades 60 is a guide member 61 which has a recess 61a (FIG. 7) to maintain the strip 28 of pouches 29 in the desired position on the blades 60. The index wheel 36 also includes a plurality of suction heads 62 which are circumferentially spaced on the periphery of the core 40 between the circumferentially spaced cutting blades or bars 60.

Figure 2:
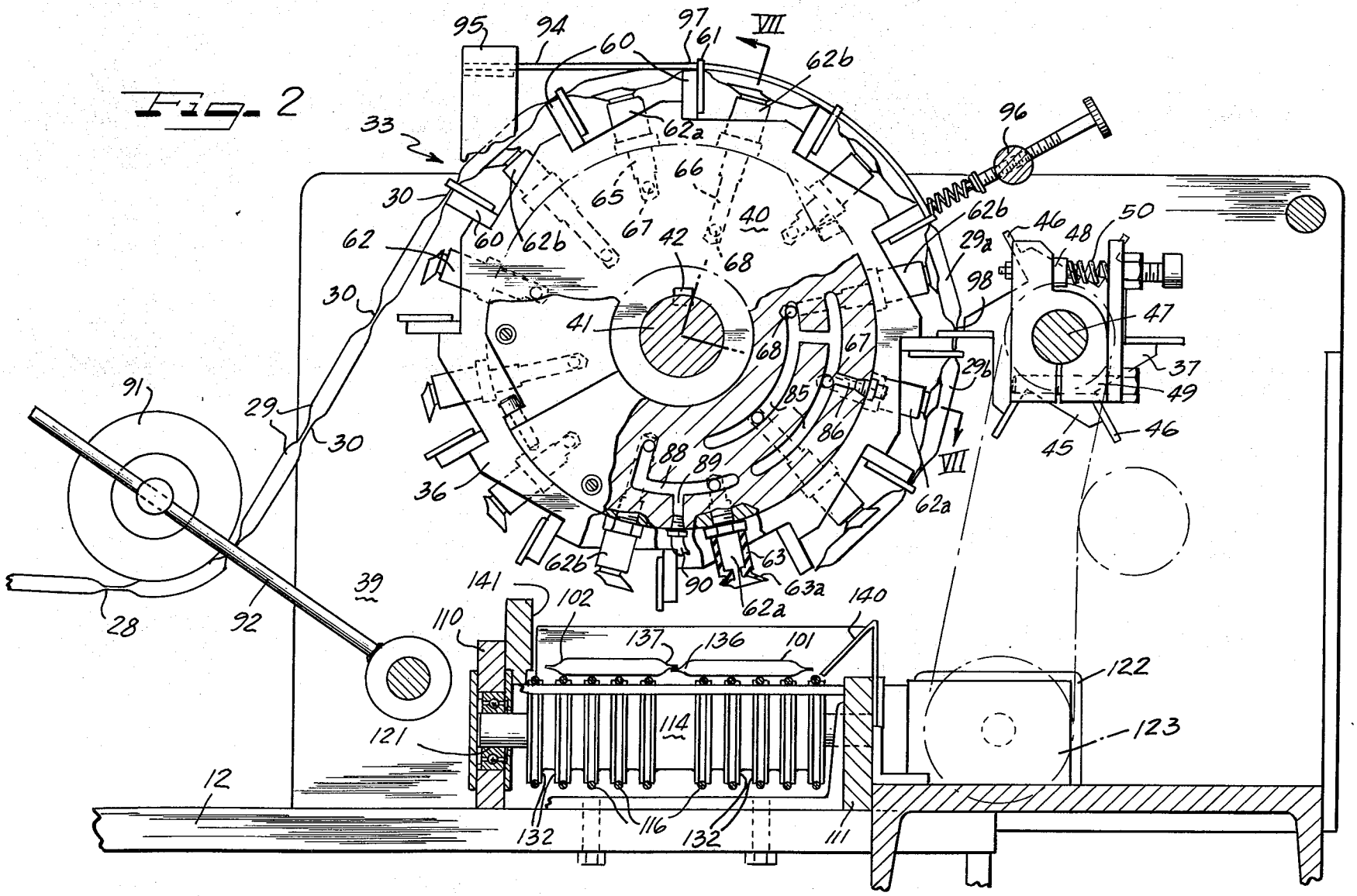
FIG. 2 is a partial fragmentary view with portions in cross section and portions broken away for purposes of illustration taken on line II—II of FIG. 1.
Figure 7:
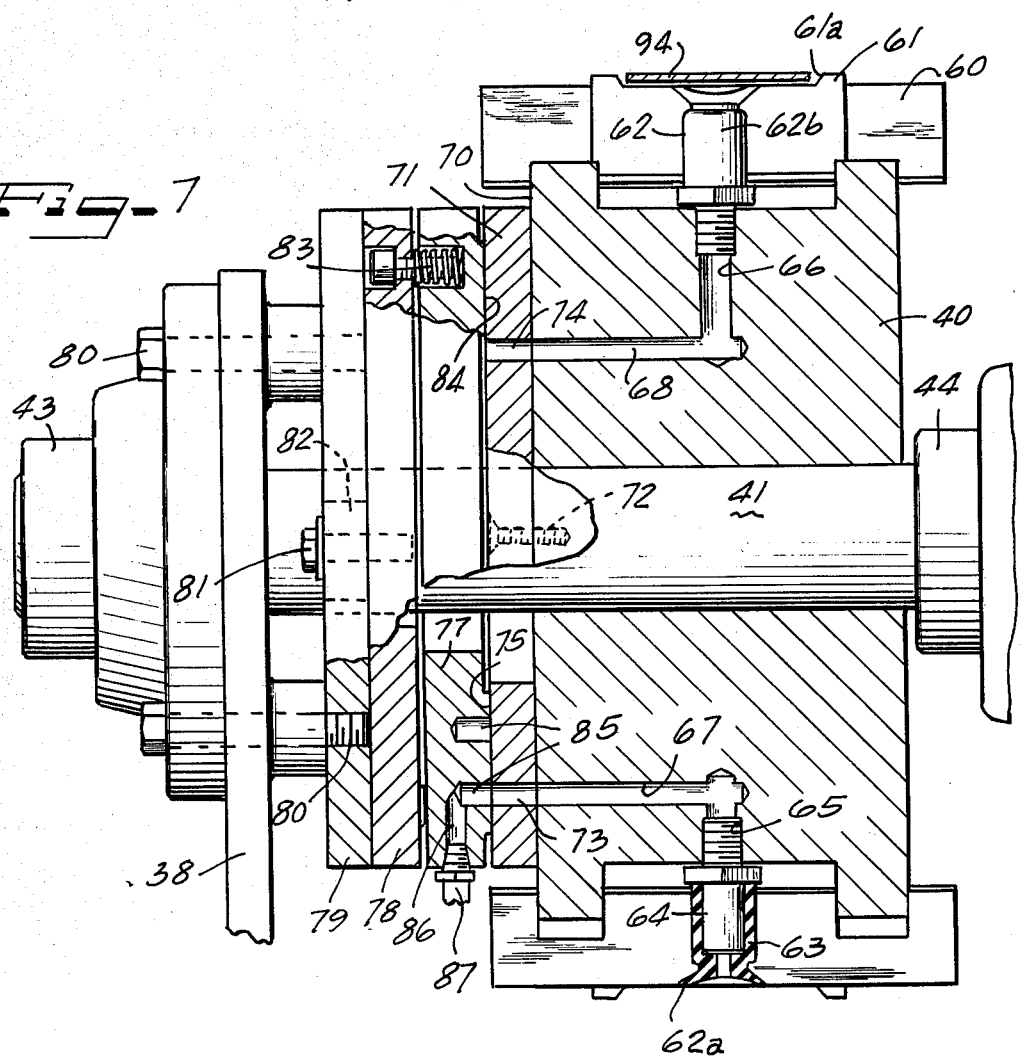
FIG. 7 is a partial cross-sectional view of the index wheel taken on line VII—VII of FIG. 2.

Each of the suction heads 62 includes a resilient member 63 which is formed of rubber or suitable resilient plastic and which member has a concave or cup portion 63*a* with a portion removed at one edge. The member 63 is telescopically received on a fitting 64 (FIG. 7). To mount the suction head 62 on the core 40, the core is provided with a plurality of radially extending bores or passageways 65 and 66, each of which threadedly receives the fitting 64 of each suction head 62. As best illustrated in FIGS. 2 and 7, the core 40 has a plurality of axially extending passageways 67 which are circumferentially spaced in the core on a circle of a given radius and which communicate with the bores 65. A second group of a plurality of axially extending passageways 68, which communicate with the bore 66, are provided in the core 40, and the passageways 68 are circumferentially spaced on a circle whose radius is less than the radius of the circle formed by the passageways 67. Thus, the effective radial depth of the bores 65 is less than the radial depth of the bores 66. Each of the suction heads 62*a*, whose fitting 64 is threadedly received in one of the bores 65, form one group of suction heads, and each of the remaining suction heads 62*b*, whose fitting is threadedly received in one of the radial bores 66, forms a second group. As illustrated in FIG. 2, the suction head 62*a* and 62*b* are alternately spaced around the periphery of the core 40.

As best illustrated in FIG. 7, the axially extending passageway 67 and 68 extend from their respective radial bores 65 and 66 to a side or surface 70 of the core 40. Overlying the side 70 is an annular plate member 71 which is attached to the core 40 by appropriate means such as threaded fastener 72 to rotate therewith. The plate 71 is provided with passageways 73 and 74. When the plate 71 is secured on the core 40, it is in sealing relationship therewith and the passageways 73 and 74 are in alignment with the passageways 67 and 68 to communicate these passageways to a surface 75.

Means are provided to selectively connect the passageways 67 and 68 to a source of vacuum during a selected arc of travel of the respective passageways during rotation of the core 40. In a similar manner, a positive air pressure (above atmospheric) is applied at a selected point of travel of each suction head 62 or during a selected segment of travel of each of the suction heads 62 through the passages 67 and 68. Both of these means utilize a manifold plate or shoe 77 which is supported on a mounting plate 78 which is adjustably mounted to a plate 79. The plate 79 is rigidly connected by appropriate means such as bolts 80 to the upright frame member 38. The adjustable mounting, which comprises fasteners 81 extending through elongated slots 82 in plate 79, enable the annular orientation of the shoe 77 to be adjusted relative to the frame member 38. The manifold plate 77, as best illustrated in FIG. 7, is biased by springs 83 against the plate 70 with a surface 84 of the plate 77 in sealing engagement with the surface 75. The surface 84 includes a recess or cavity 85 which is in communication through a radial bore 86 to a hose 87 which is connected to a source of negative pressure or vacuum (not illustrated). In a similar manner, a cavity or recess 88 (FIG. 2) is connected by a radial bore 89 to a fitting connected to a hose 90 that in turn extends to a source of positive pressure such as positive air pressure. The cavity 85 is configured to communicate with each of the suction heads 62*a* and 62*b* via the passageways 67 and 68 for selected or given arcuate movement of each of the suction heads during rotation of the index wheel 36. In a similar manner, the cavity or recess 88 is configured to communicate with each of the suction heads 62*a* during a segment of travel and to communicate with each of the suction heads 62*b* when it reaches a given point of travel during rotation of the wheel 36.

The severing means 33 also includes a guide or take up roller ruler 91 rotatably supported on a pair of levers 92 which are attached to the upright frame members such as 38 and 39. The roller 91 receives the horizontally disposed strip 28 of packets and helps locate the strip onto the index wheel 36. The strip 28 is received on the cutting bars 60 and the notch 61a of each of the guide bars 61 with the transverse seals 30 lying on each of the cutting bars 60.

To help urge each of the packages 29 into tight engagement with the suction head 62 over which they overlie, the severing device 33 includes a hold down strip 94. The hold down strip 94 has one end anchored by a support 95 to the frame member such as 39 and the other end is supported by an adjustable spring arrangement 96 which is also supported on one of the frame members. The adjustable spring arrangement 96 causes the strip 94 to assume a curvature of the arcuate path of the periphery of the index wheel 36. The curvature of the hold down strip 94 causes the packages 29 as they travel past a point indicated at 97 to be urged into engagement with the suction heads 62. The hold down strip serves the function of forcing each of the packages 29 into sealing engagement with the resilient head 63 which is mentioned above has a concave configuration with a portion adjacent the leading edge being removed. As each of the packages 29 reaches a point in the arcuate path adjacent the adjustable spring device 96, the package and its contents have been conformed by the strip 94 into a snug engagement with the underlying suction head.

As each of the transverse seals 30 between the packages 29 moves from the position adjacent the adjustable spring device 96 to a position indicated at 98, the cutting blades 46 of the cutting wheel 37 move into coaction with the cutting blades or bars 60 to begin severing the preceding package from the strip 28. The severing is completed at the seal 30 reaches the position 98. Preferably, each of the cutting bars 46 has a slight twist and is oriented at a slight pitch to the axis of the shaft 47. The spring clutch 49 provides sufficient yielding as the cutting bars 46 begin to engage the cutting bars 60 to prevent binding and to compensate for the different circular path of the bars 46 and 60.

When a package reaches the position of package 29*a* in FIG. 2, the preceding package 29*b* has been completely severed from the strip 28. However, due to the position of the recess or cavity 85 of the suction applying means, the package 29*b* is held onto the suction head such as 62*a* and will continue to move in the arcuate path of the index wheel. In the preferred embodiment, the configuration of the cavity 85 is such that a suction is applied through the heads 62 to hold the packets reaching the position 29*a* at the time that severing of its leading transverse seal 30 has been completed to separate the preceding package 29*b* from the strip 28. With continual movement of the wheel, another package 29 is moved to the position 29*a* and as it moves to this position, the cutting bars of the cutting wheel coacting with the cutting bars of the index wheel to begin to sever the transverse seal 30 connecting it to the preceding package.

To insure the positive release and ejection of a package held by suction on the suction head 62, the means for applying a positive air pressure is utilized to positively eject the packages from the suction heads 62 when they reach a desired position of travel. In the index wheel of the present invention and as illustrated in FIG. 2, the packages 29 are being deposited in two distinct positions on the conveyor means 34 to form two rows 101 and 102. To deposit packages in two different rows, one group of suction heads 62*b* must move through a larger arc of travel than the other group of heads 62*a*. Thus, the positive pressure must be applied to the suction head 62*a* after traveling through a shorter arcuate distance of travel than the arcuate distance of travel for the suction heads 62*b*. As illustrated, the cavity 88 of the means for applying a positive pressure is configured to apply the positive pressure at an earlier position to the suction heads 62*a* than to the suction heads 62*b*. In addition, the cavity 85 is configured so that a suction is maintained on the heads 62*b* for a greater arcuate distance of travel than for the suction heads 62*a* and as illustrated suction is still being applied to the heads 62*b* as positive pressure is applied to eject the package from the suction heads 62*a*.

While the package severing means can be used to deposit the severed packages or packets on any material handling device, preferably it is utilized with the conveyor means 34. The conveyor means 34 as illustrated in FIGS. 1 and 2 is positioned beneath the index wheel 36 to receive packages deposited thereon and extends in the axial direction to the chute 35. The conveyor means 34 includes a frame having at least a pair of upright frame members 110 and 111 which are supported on the base 12 of the machine 11. Received in the frame is a first conveyor portion (FIG. 5) 113 comprising a pair of sheeves or rolls 114 and 115 with a plurality of belts 116 and a second conveyor portion 117 comprising a pair of sheeves or rolls 118 and 119 with a plurality of belts 120. The rolls of the first and second conveyor portions 113 and 117 are rotatably supported in the frame member 110, 111 by appropriate bearings such as 121 (FIG. 2) with the roll 118 of the second portion 117 (See FIGS. 3 and 5) disposed between the pair of rolls 114 and 115 of the first conveyor portion so that articles being transported on the two conveyor portions are engaged by both conveyors at the point of transfer from the first portion to the second portion.

Figures 3, 4, 5:
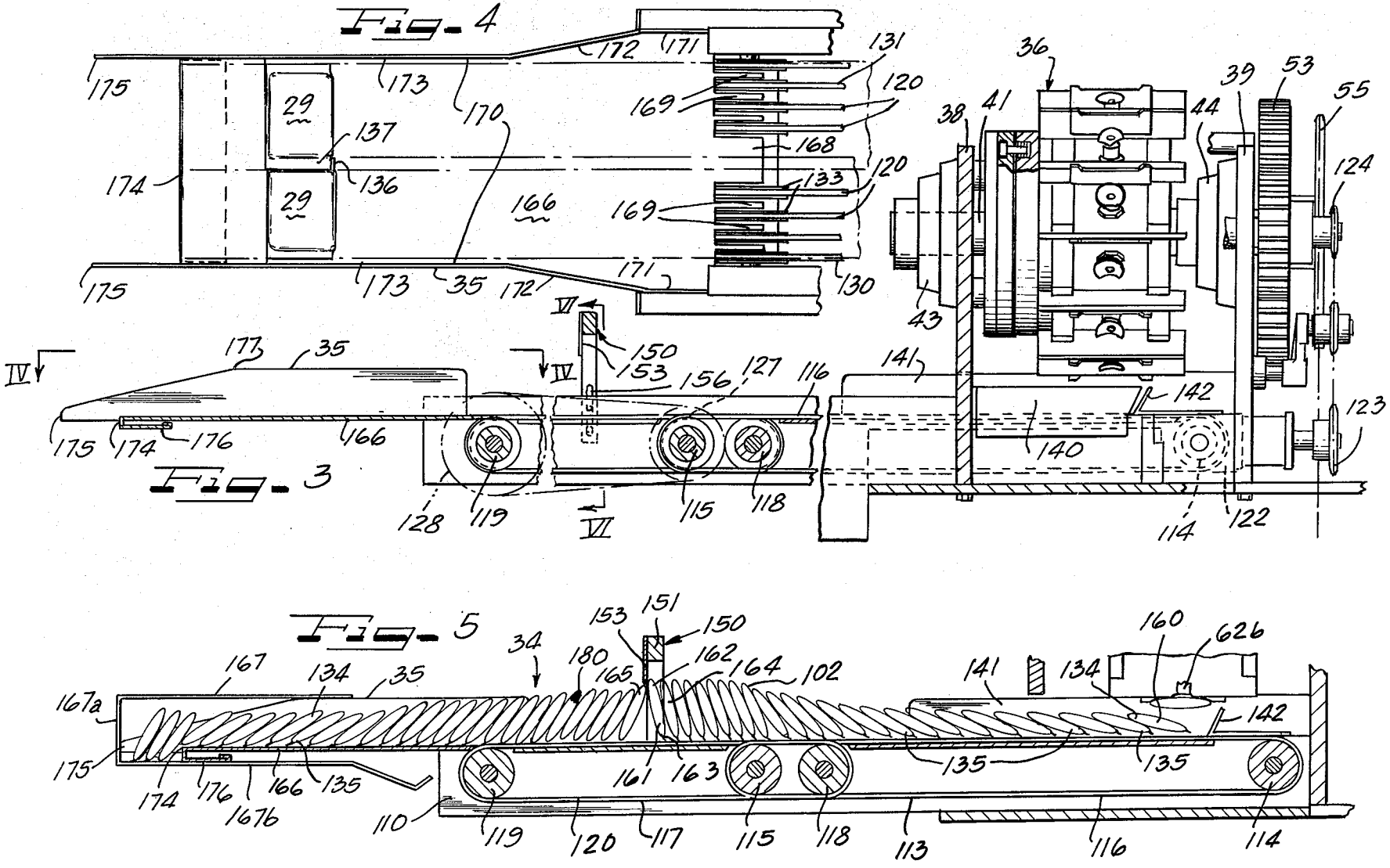
FIG. 3 is a fragmentary view with portions in elevation for purposes of illustrated taken along lines III—III of FIG. 1.
FIG. 4 is an enlarged fragmentary plan view of the chute taken on line IV—IV of FIG. 3.
FIG. 5 is a partial cross section taken along the conveyor means illustrated in FIG. 3.

To drive each of the conveyor portions 116 and 117, the sheeve 114 is connected to a right angle gear box 122 which has a sprocket 123 connected by a chain to a sprocket 124 of the shaft 47 for the cutting wheel 37. The belts 116 drive the roll or sheeve 115 of the first portion 113 and the roll is provided with a sprocket 127 which is connected by a chain to a sprocket 128 mounted on the shaft of the roll or sheeve 119 so that the second portion is driven by the first portion. As illustrated in FIG. 3, the sprocket 127 is smaller than the sprocket 128 so that the second portion 117 transports the packages at a slower speed than the portion 113.

As best illustrated in FIG. 1, the belts 116 and 120 of the first and second conveyor portions 113 and 117 are arranged on their respective rolls in two groups 130 and 131 with each group of belts being associated with one of the rows of packages 101 and 102. To maintain the belts such as 116 of the first portion 113 in the desired axial position on the rolls, the roll 114 (FIG. 2) is provided with sub-sheeve or pulley-like portions 132 which receive an individual belt 116 which has a circular cross section. The roll 115 has a similar configuration. The rolls 118 and 119 have similar sub-sheeves such as 133 (FIG. 6) which are positioned to be axially disposed between the subsheeves 132 of the first portion so that the belts 120 may pass over the roll 115 with the necessary clearance.

As best illustrated in FIG. 3, the gear 124 is smaller than the gear 123 so that the drive means for the severing device drives the conveyor means 34 at a speed which causes the packages which are deposited in each of the rows 101 and 102 to be deposited in a shingled relationship with the leading end of edge 134 of each package overlying and overlapping the following edge or end 135 of the next preceding package (FIG. 5). To obtain the shingled relationship, the speed of the conveyor means 34 is selected so that a deposited package is not completely removed from beneath the index wheel when the next package is deposited on the conveyor means.

In addition, a feature of the apparatus of the present invention is the fact that the packages in row 101 and 102 (FIG. 2) are also deposited with their marginal edges 136 and 137 which are formed by the severed transverse seals in an overlapping and overlying relationship so that the overall width of the two rows 101 and 102 is less than twice the overall width of a single row. By creating a flow of packages with the marginal edges of one row overlapping the edge of the other row, the packages in the two rows may be subsequently stacked with overlapping edges to conserve in the size of the receptacle or carton in which they are being packed. In order for the two rows 101 and 102 to have an overlapping relationship and a shingle relationship, the marginal edges of the packages of one row must always overlie the marginal edges of the packages of the other row. As illustrated in FIG. 2, the edges 137 of the packages of row 102 always overlie the edge 136 of the packages of the row 101 and this relationship is accomplished by insuring that the positive air pressure is applied to the suction heads 62*a* prior to the application of air pressure to the suction heads 62*b*. By applying pressure to the suction heads 62*a* before it is applied to 62*b* the package being deposited in row 101 is always released or ejected from the index wheel 36 before the packages being deposited into row 102. In addition, the conveying device is provided with a guide or deflection plate 140 and a bang board or guide plate 141 to facilitate the overlapping relationship between the packages in the two rows 101 and 102. As illustrated in FIGS. 3 and 5, to insure the shingled relationship, a deflection plate 142 is also provided to extend transversely across the belts of the first conveyor portion 113.

Figure 6:
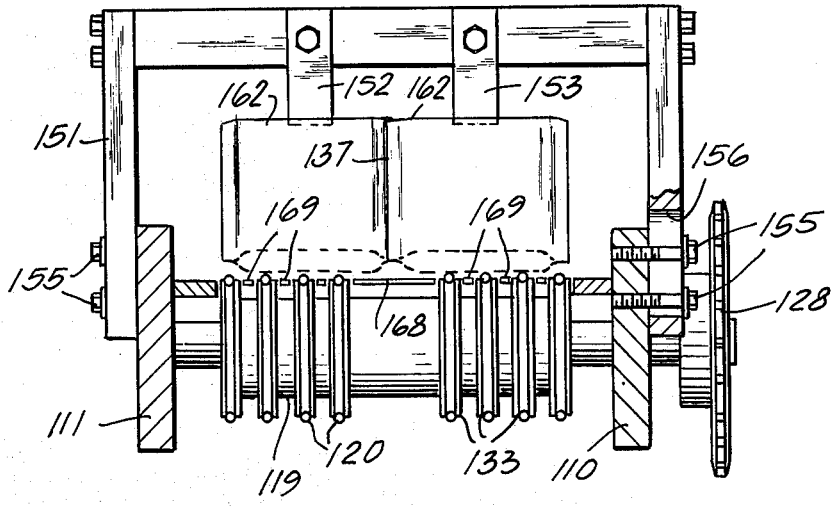
FIG. 6 is a fragmentary view taken along lines VI—VI of FIG. 3.

An important feature of the present invention is the provision of means generally indicated at 150 for reversing the shingled direction of the shingled packages of two rows 101 and 102 so that as the articles are transported onto the tray 35 the trailing edge of each article or package overlaps and overlies the leading edge of the following article. Referring to FIGS. 5 and 6 the means 150 for reversing the shingled direction comprises the stand 151 which is adjustably connected to the upright members 110 and 111 to extend above and across the second portion 117 of the conveyor means 34. The stand 151 supports a pair of engagement means or elements 152 and 153 above the belts 120 with the element 152 being disposed directly above the row 101 of the shingled articles and the element 153 being disposed above the row 102. The stand 151 is mounted by a pair of bolts 155 which extend through an elongated slot 156 to enable adjusting the height of the end of each of the elements 152 and 153 above the belts 120 so that each of the elements 152 and 153 terminate at a distance above the belts 120 which is less than the width or dimensions of the packages such as 29 in each of the rows 101 and 102.

When the packages 29 are deposited on the conveyor means 34 by the index wheel 36, they have a shingled orientation with each package being substantially parallel to the planes of the conveyor belts 116 or only at a slight inclination which is dependent on the thickness of the package. This relationship is illustrated in FIG. 5 by the package designated as 160. The engagement means or elements 152 and 153 coact with the moving belts 116 and 120 of the conveyor means 34 to cause the shingled articles or packages to progressively pivot or rotate about their respective trailing edge or end 135 as the package is transported toward the reversing means 150. This coaction causes the packages to gradually assume a substantially upright or vertical orientation to the plane of the conveyor belt as it reaches the position of package 161 which is immediately adjacent the engagement elements 152 or 153. The coaction between the engagement elements 152 and 153 and the belts of the conveyor means is due to the engagement element engaging the upright leading edge 162 of the immediately adjacent package 161 and restraining or blocking further movement of the edge 162 in the direction of travel of the flow of articles or packages. The lower trailing edge 163 of package 161 is still being transported by the belts as are the trailing edges of each package. Thus as a package approaches the reversing means 150, the leading edge is progressively restrained from moving in the direction of flow as the trailing edge continues to move in the flow direction.

At the reversing means 150, the upper edge 162 is restrained by the element 152 and 153 and the lower edge 163 will be transported beneath the upper edge 162 to become the leading end or edge. When the lower edge 163 has passed beneath the element 152 or 153 and continues to move toward the end of the conveyor belts, the upright edges 162 will begin to move back toward the plane of the belts and rest on the next adjacent package 164. Thus as the lower edge reaches a position illustrated by package 165, the upper edge has assumed a position that releases it from the engagement means 152 and allows it to continue to move in the direction of the flow or stream of articles and the next adjacent package 164 moves to the position of package 161. After passing the reversing means, the end or edge 134 which were the previous leading edge are now the trailing edges and overlap and overlie the leading edge 135 of the following article. As illustrated the upstanding orientation of the articles which have passed the reversing means progressively decreases as they are moved toward the end of the conveyor means 34 to be deposited on a bottom wall or surface 166 of the tray 35.

As mentioned above, packages transported by the conveyor means 34 are deposited on a chute 35 for subsequent stacking in a receptacle, carton or box 167 (FIG. 5) which is telescopically received on an end of the chute. To facilitate transfer of the flow or stream of packages from the conveyor means 34 to the chute 35, the bottom wall 166 has a projection or tab 168 (FIG. 4) which extends between the belt group 130 and 131 and a plurality of narrow tabs or projections 169 which extend between the sub-sheeves 133. The chute 35 includes a pair of upstanding side walls 170, 170 each of which has three portions 171, 172 and 173. These portions are configurated to form a funnel from point of transfer from the conveyor means 34 to the chute 35. The downstream ends of portions 173 of the upright walls 170 extend past an end 174 of the chute bottom wall 166 to a point or edge 175. The point 175 serves as a stop engageable by the bottom wall of a carton so that as a carton 167 is inserted on the chute, the end 174 of the bottom wall 166 will be spaced from the bottom wall 167*a* of the carton.

To maintain spacing of the bottom wall 166 from a side wall 167*b* of the carton 167, means 176 for spacing are provided at the end 174. The means 176 is illustrated as a portion of the bottom wall 166 which has been turned under the wall 166 or bent into a reverse bend.

To facilitate the telescoping of the carton 167 onto the tray, the side wall portions 173 are provided with a tapered configuration of decreasing height. As illustrated, the height of the portion 173 from a point 177 gradually decreases as the end 175 is approached.

As mentioned above, the shingled direction of the packages as deposited on the first portion 113 is reversed by the means 150 to the shingled direction of the articles which are received by the tray. This reversal of the shingled direction provides a better packing factor in the receptacle or box 167 by the stacking of the two rows 101 and 102 in two stacks with the marginal edge portions 136 and 137 of the two stacks being in an overlapping relationship. Without reversing the shingled direction, problems were incurred with the articles particularly in the base of the stack falling out of the desired relationship to produce the stack. However, by reversing the orientation of the shingled direction to that illustrated on the tray 35, movement of the articles into the box insures a stack with the articles being substantially parallel to the base 167*a* of the receptacle 167.

The operation of the present apparatus envisions an operator positioned adjacent to the tray 35 for manually inserting a portion of the shingled stack or flow on the tray 35 into the receptacle or box 167. To aid and insure that the desired number of packets or packages are placed in each carton 167, the printing device such as 16 can place an identifying mark on a package at an interval of a given number of packages such as every package. As illustrated in FIG. 5, a package 180 is provided with an identifying mark. The operator by grasping the package 180 in the particular row plus the adjacent package in the other row and then manually pulling all of the packages between the package 180 and the end of the tray 35 towards the receptacle 167 can insure loading or packing a desired number, such as 50 articles, into the box 167. It should be noted that while 50 was given as the example of marking, other intervals such as 80 or 100 could be utilized.

After moving all the articles from the package 180 into the receptacle 167, the box is removed from the tray 35 and placed on a conveyor for further processing. As illustrated in FIG. 1, a flat surface 181 is provided adjacent to the tray 35. By utilizing appropriate vibratory means, the flat surface 181 can be a vibrating table to insure desired settling of the articles in the carton 167. During the time required for removing the carton 167 and inserting an empty carton or box 167 back onto the tray 35, another group of packages is transported along the conveyor means into the position such as illustrated in FIG. 5. When the operator sees another marked package such as 180, another known quantity of packages 29 can be inserted in the newly placed empty receptacle 167.

It should be noted that at the beginning of the operation of the machine 11, the uprighting of the flow of shingled articles or packages must be manually aided. This may be accomplished by manually holding a package in position 161 adjacent the reversing means until the flow resembles the flow indicated in FIG. 5.

The apparatus 10 may include a waste removal chute (not illustrated) disposed beneath the cutting wheel 37 and adjacent the index wheel 36 for removing scrap or waste materials. For example, during initial set up of the machine 11, empty packages may be produced; however, the suction heads 62 will not grasp an empty packet. Thus a severed empty package will fall onto the waste removal chute for removal from the apparatus 10. If during operation of the machine 11, a malfunction occurs such as a failure of the filling device 26 to fill the pouches, the unfilled pouches or packages will not be transported by the suction heads 62 to the conveyor means 34 and will be removed by the above-mentioned waste removal chute.

Although minor modifications might be suggested by those versed in the art, it should be understood that we wish to employ within the scope of the patent granted hereon all such modifications as reasonably and properly come within the scope of our contribution to the art.

We claim:

1. An apparatus for packing individually filled pouches in a receptacle, the apparatus comprising:

an index wheel, means for rotating said index wheel in an arcuate path;

conveyor means disposed beneath said wheel and traveling in a direction perpendicular to the path of said wheel for transporting the pouches a chute located at the downstream end of said conveyor means for receiving said pouches, individual suction heads circumferentially spaced on said wheel, said suction heads being carried in a circular path by said one wheel;

means for applying a suction to each of the suction heads as the wheel moves the head through a segment of the circular path so that the head grasps a pouch overlying said head; and means for applying a positive pressure to each of said suction heads as it is disposed above said conveyor means to insure release of the package from each head to be deposited on the conveyor means for transfer to the chute.

2. An apparatus according to claim 1, wherein the means for driving the wheel and the conveyor means times the movement of the conveyor means relative to the movement of the wheel so that the pouches are deposited on the conveyor means in a shingled relationship with the leading edge of each pouch overlying and overlapping the trailing edge of the next preceding pouch.

3. An apparatus according to claim 2, which further includes means disposed along the conveyor means between the wheels and chute for reversing the shingle direction of the flow of pouches conveyed thereon so that the pouches delivered to the chute have a shingled relationship with the trailing edge of each package overlapping and overlying the leading edge of the following package.

4. An apparatus according to claim 3, wherein the means for reversing comprises engagement means positioned above the surface of the conveyor means a distance less than the dimensions of the pouch being conveyed thereon for restraining movement of the leading edge of the pouch adjacent the engagement means, and said engagement means coacting with the conveying means to cause the pouches to be gradually raised from a substantially parallel relation to the conveying means to a substantially upright position as the pouches approach said engagement means, and said engagement means restraining movement of the upright leading edge of the pouch until the trailing edge moves therebeneath so that the orientation of the pouch is reversed.

5. An apparatus according to claim 4, wherein the conveyor means comprises a first and second conveyor portion with the second portion transporting the stream of pouches at a speed lower than the speed of transporting of the first portion and wherein the means for reversing is disposed along the second portion.

6. An apparatus according to claim 5, wherein each portion of the conveyor means comprises a pair of sheeves with a plurality of individual belts disposed therebetween and wherein one of the sheeves of the second portion is arranged between the pair of sheeves of the first portion so that the stream of pouches are acted on by both conveyor portions during transfer from the first portion to the second portion.

7. An apparatus according to claim 1, wherein said conveyor means extends in a direction parallel to the axis of said wheel and wherein the means for applying a positive pressure to each of said suction heads applies a pressure to adjacent suction heads at different points of travel of the head so that adjacent pouches carried thereby are ejected in two rows on the conveyor means.

8. An apparatus according to claim 7, wherein the different points of travel are spaced apart a distance which is less than the distance between the pouch width dimensions so that the pouches in the two rows have an overlapping edge relationship.

9. An apparatus according to claim 8, wherein the means applying positive pressure applies positive pressure to the heads depositing pouches in one row prior to applying positive pressure to the heads depositing pouches in the adjacent row so that an edge portion of the pouches in one row overlies the edge portion of the pouches in the other row.

10. An apparatus according to claim 9, wherein the means for driving the wheel and the conveyor means times the movement of the conveyor means relative to the movement of the wheel so that the pouches in each row are deposited on the conveyor means in a shingled relationship with the leading edge of each pouch overlying and overlapping the trailing edge of the next preceding pouch and with marginal edges of the pouches in one row overlying and overlapping the marginal edges of the packages of the other row.

11. An apparatus according to claim 10, which includes means disposed along the conveyor means between the wheel and the chute for reversing the shingled direction of the flow of both rows of pouches conveyed thereon so that the overlapping rows of pouches delivered to the chute have a shingled relationship with the trailing edge of each pouch overlapping and overlying the leading edge of the following pouch.

12. An apparatus according to claim 11, wherein the conveyor means deposits the overlapping rows of shingled pouches on the chute for subsequent depositing in a receptacle disposed on said chute.

13. An apparatus according to claim 1, wherein the chute has a bottom wall and a pair of upstanding side walls, said side walls at an end opposite the conveyor means extending passed the end of the bottom wall, and said chute having means at said end of the bottom wall for spacing the bottom wall from a wall of the receptacle when the chute is received therein.

14. An apparatus according to claim 11 wherein the means for reversing comprises engagement means positioned above the surface of the conveyor means a distance less than the height dimensions of the pouches being conveyed thereon for restraining movement of the leading edge of the pouches of each row adjacent the engagement means, said engagement means coacting with the conveyor means to cause the pouches to gradually rise from a substantially parallel relationship to the conveyor means to a substantially upright position as the pouches approach said engagement means, and said engagement means restraining movement of the upright leading edge of the adjacent pouches of each row until the trailing edge moves therebeneath so that the orientation of the packages of both rows are reversed.

15. An apparatus according to claim 14, wherein the conveyor means comprises a first and second conveyor portion with the second portion transporting the stream of pouches at a speed lower than the speed of transporting of the first portion and wherein the means for reversing is disposed along the second portion.

16. An apparatus according to claim 15, wherein each portion of the conveyor means comprises a pair of sheeves with a plurality of individual belts disposed therebetween and wherein one of the sheeves of the second portion is arranged between the pair of sheeves of the first portion so that the flow of pouches are acted on by both conveyor portions during transfer from the first portion to the second portion.

17. Apparatus for packing pouches comprising, an indexing wheel having a plurality of suction heads spaced around its periphery, means for rotating said wheel, a conveyor passing below and at right angles to the rotary path of said wheel, and means for applying vacuum to said heads to grasp individual pouches, and means for releasing said vacuum at predetermined angular positions of said wheel to cause said heads to release said pouches in shingled fashion on said conveyor.

18. Apparatus for orienting pouches comprising, an indexing wheel having a plurality of suction heads spaced around its periphery, means for rotating said wheel, a conveyor passing below and at right angles to the rotary path of said wheel, means for applying vacuum to said heads to grasp individual pouches, and means for releasing said vacuum at different predetermined angular positions of said wheel to cause said heads to release said pouches onto said conveyor to form a plurality of rows of pouches on said conveyor.

* * * * *